US006494733B2

(12) United States Patent
Saka et al.

(10) Patent No.: US 6,494,733 B2
(45) Date of Patent: Dec. 17, 2002

(54) CONNECTOR

(75) Inventors: Yukinori Saka, Yokkaichi (JP); Koji Okutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/090,072

(22) Filed: Mar. 1, 2002

(65) Prior Publication Data

US 2002/0127901 A1 Sep. 12, 2002

(30) Foreign Application Priority Data

Mar. 7, 2001 (JP) ..... 2001-063916

(51) Int. Cl.[7] ..... H01R 13/627
(52) U.S. Cl. ..... 439/352
(58) Field of Search ..... 439/352, 489, 439/488, 188

(56) References Cited

U.S. PATENT DOCUMENTS 5,876,244 A * 3/1999 Tabata ..... 439/352
5,984,705 A * 11/1999 Miyazaki et al. ..... 340/687
6,247,957 B1 * 6/2001 Hasegawa ..... 439/352
6,280,225 B1 * 8/2001 Nishide et al. ..... 439/159
6,319,041 B1 11/2001 Nishide et al. ..... 439/352
6,332,804 B2 * 12/2001 Kurimoto et al. ..... 439/188
6,358,081 B1 * 3/2002 Saka et al. ..... 439/352

* cited by examiner

*Primary Examiner*—Tulsidas Patel
*Assistant Examiner*—Phuong K Dinh
(74) *Attorney, Agent, or Firm*—Anthony J. Casella; Gerald E. Hespos

(57) ABSTRACT

A connector (20) has a housing (18) for accommodating female terminal fittings (22). A resiliently deformable lock arm (46) is formed separately from the housing (18) and is adapted to lock the connector (20) to a mating connector (10). Coil springs (40) bias the lock arm (46) forwardly to a usual position. Insufficient connection preventing portions (34) project from the housing (18) toward the lock arm (46) and the lock arm (46) is provided with stroke guides (51). The stroke guides (51) move onto the insufficient connection preventing portions (34) during connection of the connectors (10, 20). The housing (18) also has an arched press-preventing portion (32) for preventing the lock arm (46) from being pressed from above when the lock arm (46) is at the usual position.

11 Claims, 15 Drawing Sheets

CONNECTOR

BACKGROUND OF THE INVENTION

1. Field of the Invention

The present invention relates to a connector.

2. Description of the Related Art

A known connector is identified by the numeral 100 in FIG. 18, and has a lock arm 101 with a locking projection 101A. The connector 100 also has a housing 102 that is formed separately from the lock arm 101. Insufficient connection preventing portions 103 are formed on the housing 102, and stroke guides 104 project from opposite sides of the lock arm 101 at locations near the insufficient connection preventing portions 103. A biasing member (not shown) urges the lock arm 101 forwardly and into a position where the stroke guides 104 are forward of the insufficient connection preventing portions 103.

The connector 100 can be mated with a mating connector 105. During this connection, the front surface 106 of the mating connector 105 engages the locking projection 101A and pushes the lock arm 101 rearward or to the right in FIG. 18. The stroke guides 104 move onto the insufficient connection preventing portions 103 and are guided around the rear of the insufficient connection preventing portions 103 as the connectors 100, 105 reach their proper connection positions. The stroke guides 104 then move forward below the insufficient connection preventing portion 103 and return to their usual position (see arrow A in FIG. 18). At this stage, the locking projection 101A of the lock arm 101 engages a locking portion 105A of the mating connector 105 to lock the two connectors 100, 105 together.

The biasing member pushes the lock arm 101 forward if the two connectors 100, 105 are not connected completely and if the locking projection 101A and the locking portion 105A are not engaged with each other. Thus, the connectors 100, 105 are biased away from each other and are detached. In this way, the insufficiently connected state where the locking projection 101A is not engaged with the mating connector 105 can be prevented.

The lock arm 101 may be deformed mistakenly if the rear upper end of the lock arm 101 is pressed down in the direction of arrow F in FIG. 18. In such a case, the stroke guides 104 may move under the insufficient connection preventing portions 103. Accordingly, the front surface 106 will not contact the locking projection 101A during the connecting operation. Therefore, the biasing force of the biasing member does not act, and the two connectors 100, 105 are left insufficiently connected.

In view of the above situation, an object of the present invention is to provide a connector with improved operability, which can securely prevent insufficient connection with a mating connector.

SUMMARY OF THE INVENTION

The invention relates to a connector with a housing for accommodating at least one terminal fitting. A resiliently deformable lock arm is formed separately from the housing and is adapted to lock the connector and a mating connector together. At least one biasing member is provided for biasing the lock arm toward a usual or front position along a connection direction with the mating connector. An insufficient connection preventing portion and a press-preventing portion are provided on the housing. The press-preventing portion prevents the lock arm from being pressed when the lock arm is at the usual position. Accordingly, the connectors cannot be connected by mistakenly pressing the lock arm and causing the lock arm to undergo a resilient deformation. Thus, insufficient connection can be prevented more securely.

The insufficient connection preventing portion preferably projects from the housing toward the lock arm.

A stroke guide preferably is provided on the lock arm and moves onto the insufficient connection preventing portion as the lock arm is pressed and moved back by a mating connector during a connecting operation.

The biasing member biases the lock arm toward the usual position in the housing and may be a metallic spring, such as a coil spring or a leaf spring or a spring made of rubber or a synthetic resin. Preferably, the stroke guide comprises at least one guide surface for contacting at least one corresponding guide surface of the insufficient connection preventing portion.

The lock arm may be disposed in a mounting groove in the housing and the press-preventing portion may bridge the opposite lateral edges of the mounting groove. Accordingly, the press-preventing portion strengthens the housing.

Front-stop means may be provided on the lock arm to contact corresponding stop means in the connector for locating the lock arm in the usual position.

A jig may be insertable between the press-preventing portion and the lock arm for detaching the connector from the mating connector. The press-preventing portion may act as a fulcrum for the jig for deflecting the lock arm when the connector is to be detached from the mating connector.

Side walls may be provided on the housing at positions slightly spaced from the lock arm to substantially surround side surfaces of the lock arm.

These and other objects, features and advantages of the invention will become more apparent upon reading of the following detailed description. It should be understood that even though embodiments are described separately, single features thereof may be combined to additional embodiments.

DETAILED DESCRIPTION OF THE PREFERRED EMBODIMENTS

Figure 1:
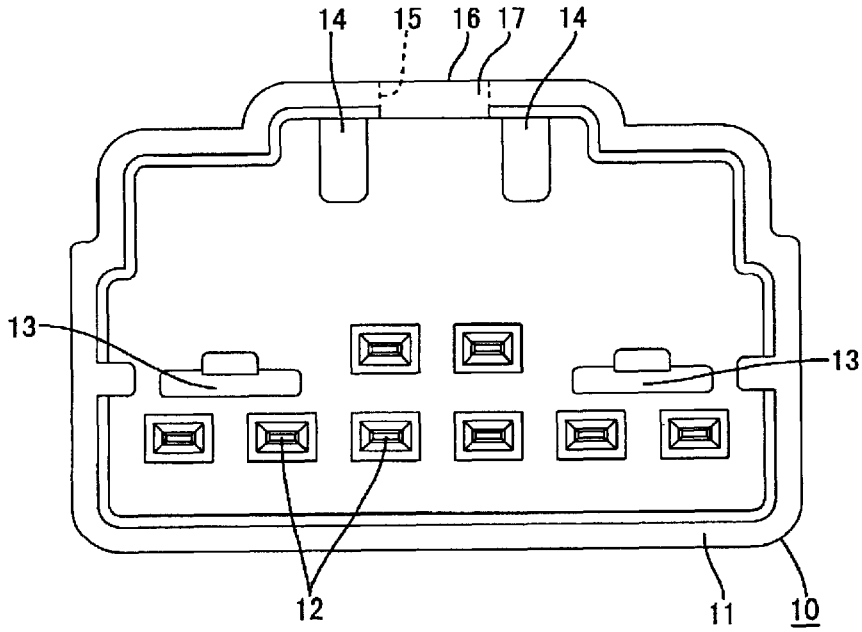
FIG. 1 is a front view of a mating connector according to one embodiment of the present invention.
Figure 2:
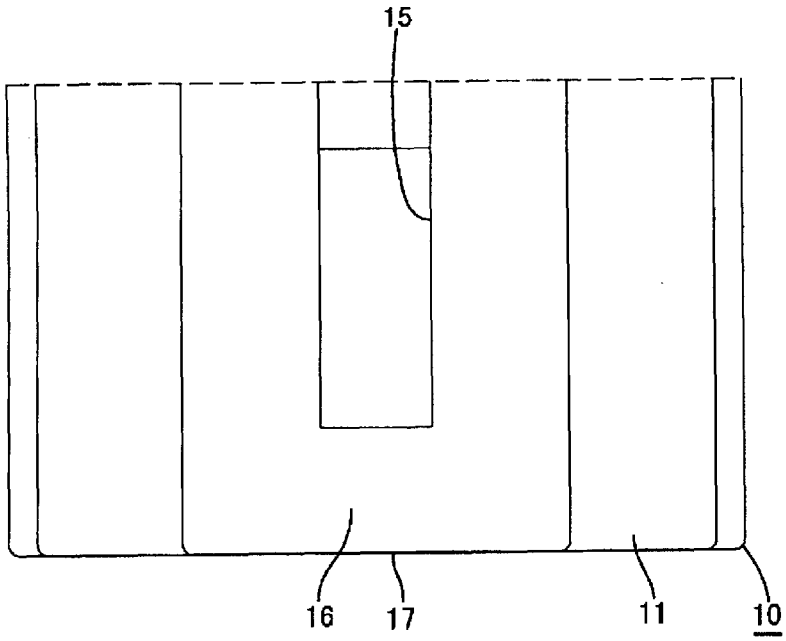
FIG. 2 is a plan view of the mating connector.
Figure 6:
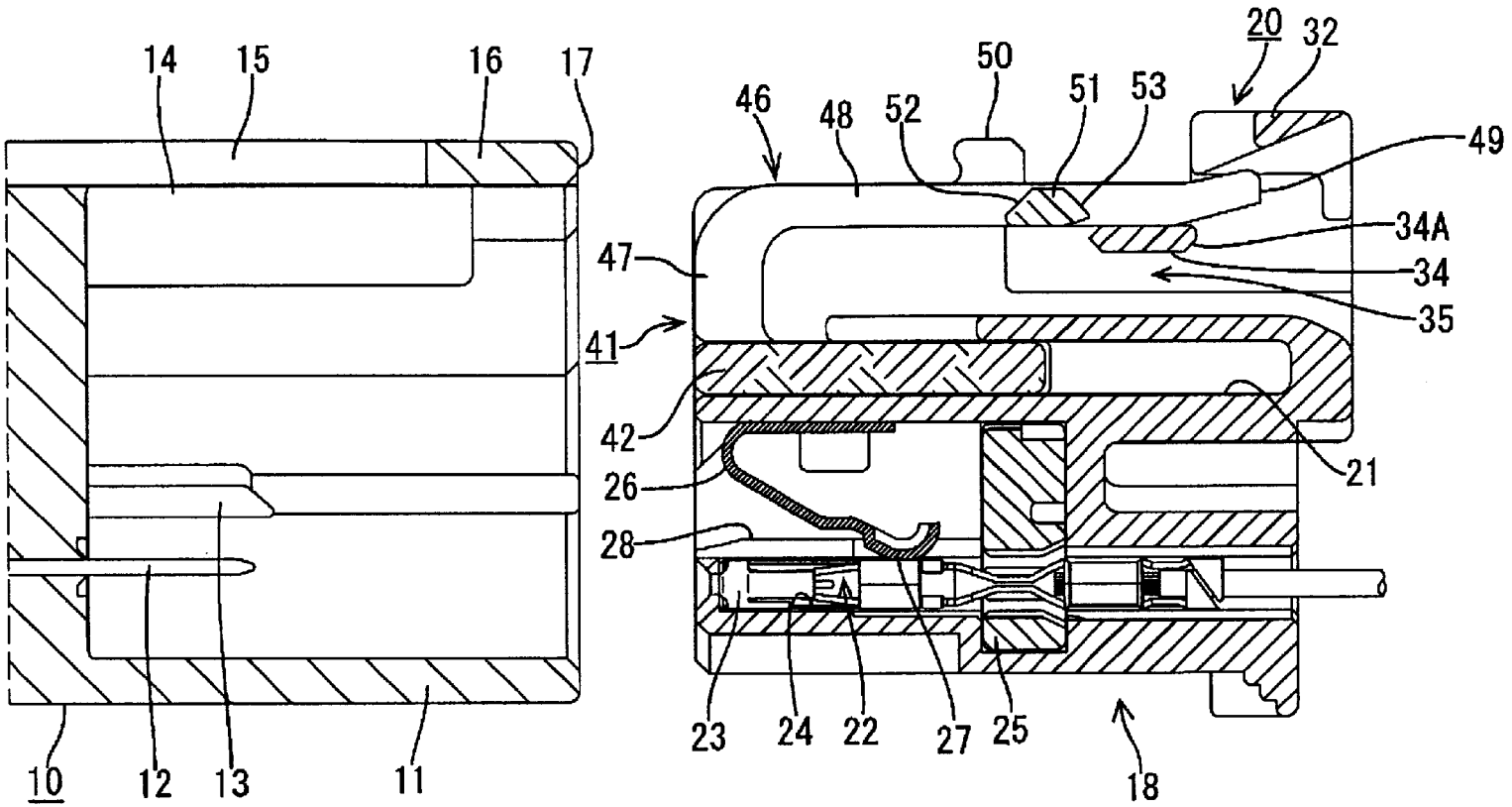
FIG. 6 is a section along 6—6 of FIG. 3 before the connector is connected with the mating connector.

A mating connector is identified by the numeral 10 in FIGS. 1, 2 and 6, and is coupled directly to a piece of equipment as shown in FIG. 6. The mating connector 10 has a receptacle 11 with an open front. Eight male terminal fittings 12 project into the receptacle in upper and lower stages. More particularly, two terminal fittings 12 are disposed in a widthwise center of the mating connector 10 in the upper stage and six male terminal fittings 12 are disposed in the lower stage. Shorted state canceling pieces 13 project into the receptacle 11 at the left and right sides of the upper stage male terminal fittings 12. Left and right guide ribs 14 project inwardly from the ceiling surface of the receptacle 11, and an engaging groove 15 extends back between the left and right guide ribs 14 in the upper wall of the receptacle 11.

The receptacle 11 of the male connector 10 is dimensioned to receive at least portions of a housing 18 of a female connector 20, as shown in FIGS. 3–15. The housing 18 includes a chamber 21 for accommodating coil springs and a slider, as explained further below. The housing 18 also accommodates female terminal fittings 22 in cavities 24. The cavities 24 are disposed to align with the male terminal fittings 12 when the connectors 10, 20 are connected. In the following description, sides of the connectors 10, 20 that are to be connected with each other are referred to as the front.

The female terminal fittings 22 have metallic locks 23 that lock with unillustrated engaging portions in the cavities 24. Additionally, a retainer 25 is mounted in the housing 18 and projects into the cavities 24, as shown in FIG. 6, to achieve double locking of each female terminal fitting 22.

Figure 3:
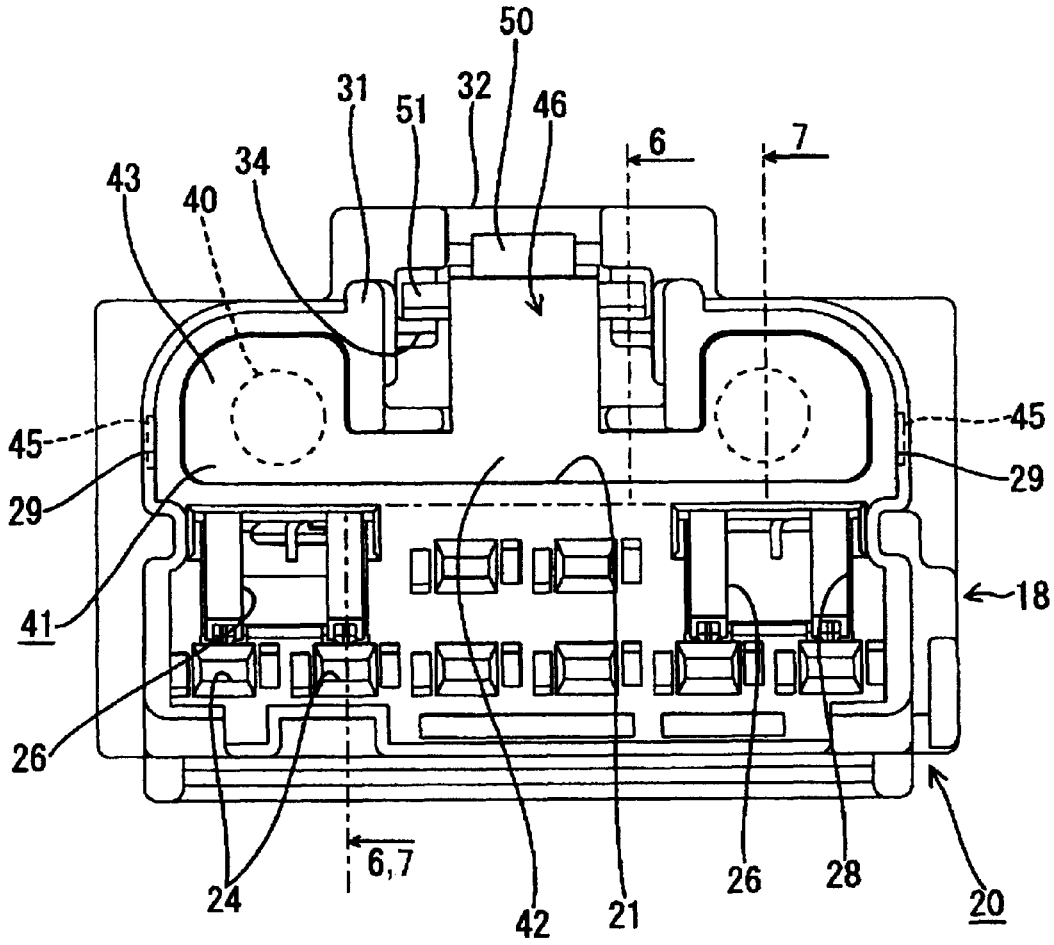
FIG. 3 is a front view of the connector.

Forked shorting terminals 26 are mounted in shorting terminal chambers 28 disposed at the left and right sides of the cavities 24 of the upper stage, as shown in FIG. 3. Each shorting terminal 26 communicates with the two cavities 24 below the shorting terminal chamber 28. Thus, contacts 27 of each shorting terminal 26 contact the female terminal fittings 22 in the respective cavities 24 to short the contacted female terminal fittings 22.

Figure 4:
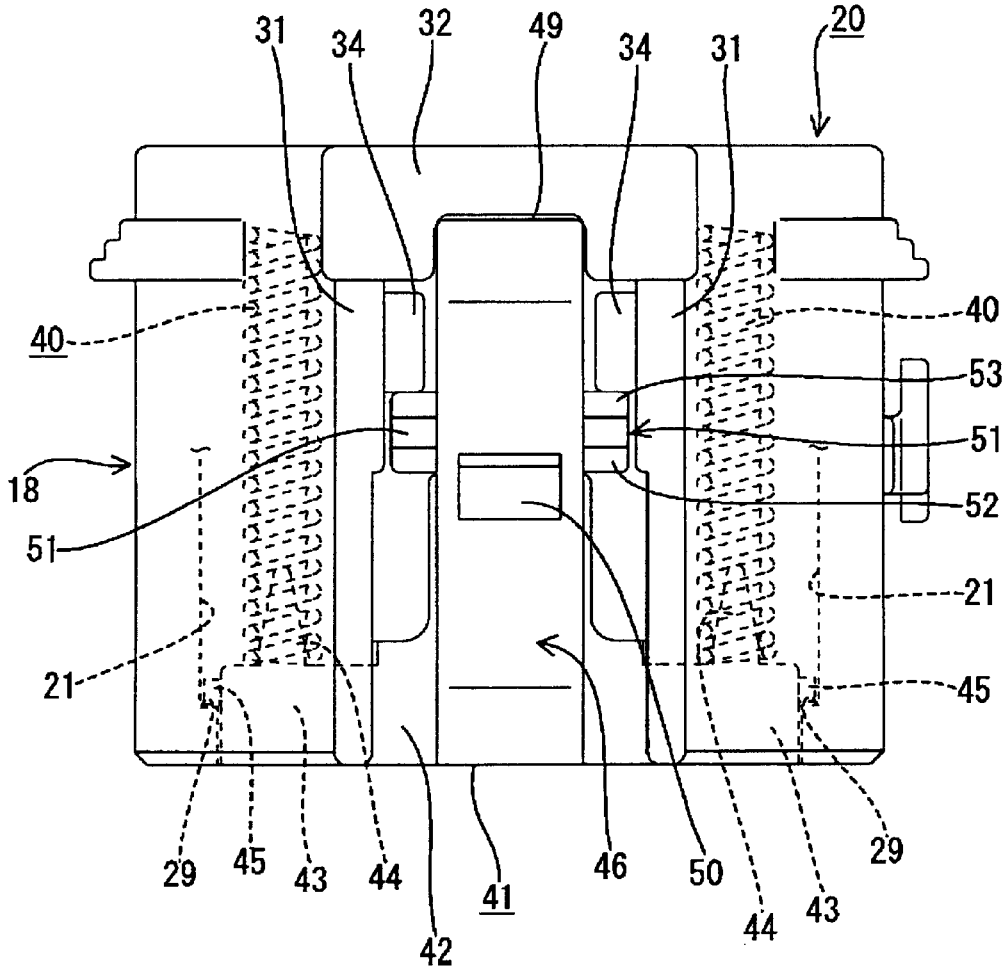
FIG. 4 is a plan view of the connector.

The accommodating chamber 21 has an open front end, as shown in FIGS. 3 and 4. A resiliently deformable coil spring 40 is inserted from the front into each of the left and right sides of the accommodating chamber 21, and a slider 41 is fit adjacent the coil springs 40 over substantially the entire width of the accommodating chamber 21 while slightly compressing the coil springs 40.

Figure 7:
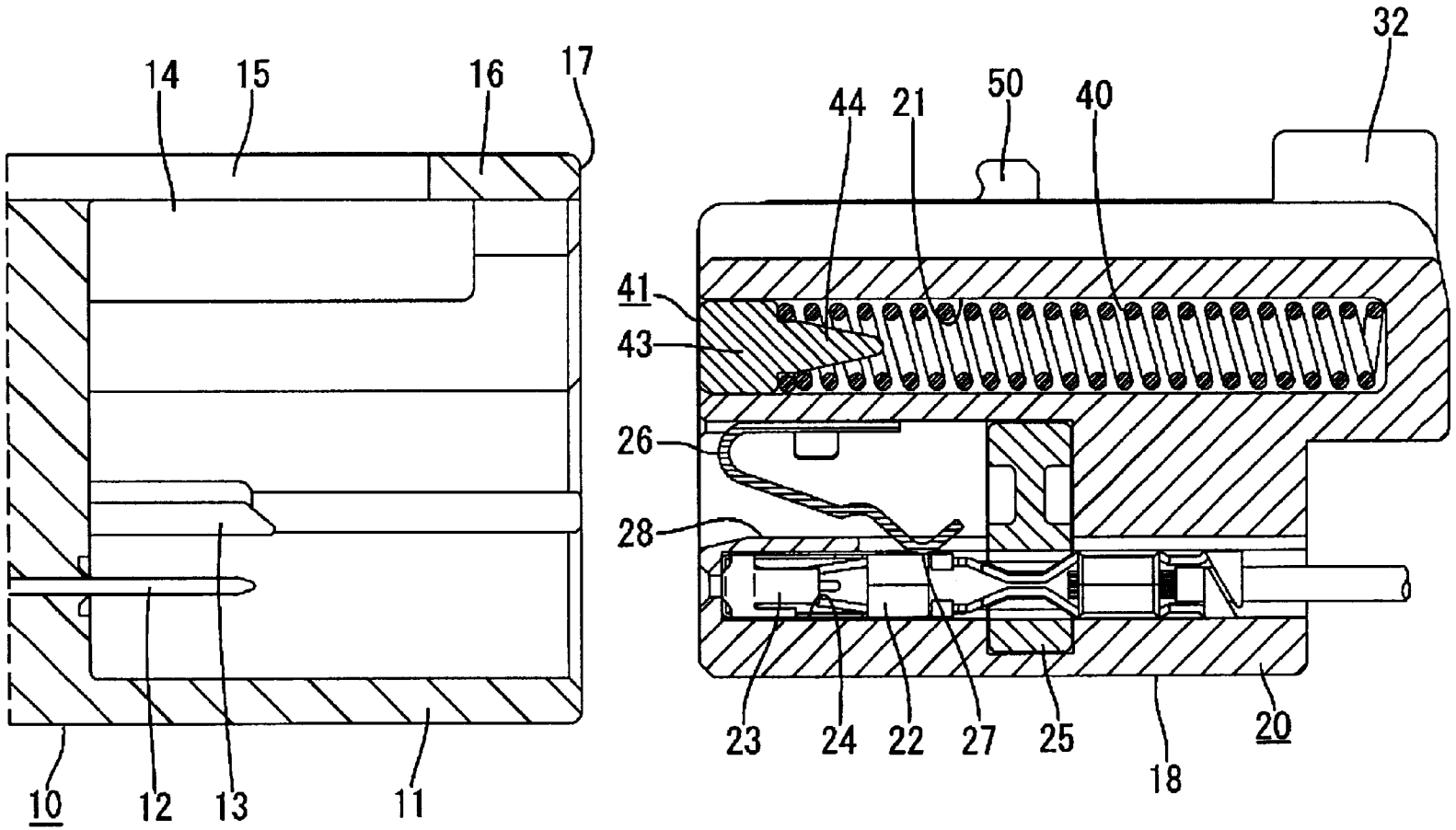
FIG. 7 is a section along 7—7 of FIG. 3 before the connector is connected with the mating connector.

The slider 41 has a flat plate-shaped main portion 42 substantially in the widthwise center of the slider 41, as shown in FIG. 4. Spring pressing portions 43 are at the left and right sides of the main portion 42, and each spring pressing portion 43 has a conical holding portion 44 that can be inserted in the corresponding coil spring 40. The slider 41 is slideable in forward and backward directions in the accommodating chamber 21, as shown in FIG. 7, and hence is moveable substantially along a mating or connecting direction of the female connector 20 with the mating connector 10. However, the slider 41 normally is biased forward toward the mating connector 10 by the coil springs 40. A front-stop projection 45 projects transversely from the outer side surface of each spring pressing portion 43 of the slider 41. Thus, the slider 41 is stopped at its front-limit position by engagement of the front-stop projections 45 with stoppers 29 that project in from the front ends of the opposite inner side surfaces of the accommodating chamber 21.

A cantilever-shaped resilient lock arm 46 projects integrally from the upper surface of the main portion 42 of the slider 41, as shown in FIG. 6. The lock arm 46 is displaceable with the slider 41 in forward and backward directions with respect to the housing 18. The slider 41 has a normal forward-most position where the lock arm 46 is held stationary with respect to the housing 18 by the engagement of the stoppers 29 and the front-stop projections 45. Thus, the slider 41 is in its usual position when no force acts on the slider 41 except the biasing force of the coil springs 40 so that the slider 41 is in one extreme position of its movable range.

The upper wall of the accommodating chamber 21 of the housing 18 has a mounting groove 30 (FIGS. 11, 12) for permitting the insertion of the lock arm 46. Two side walls 31 are provided on the upper surface of the accommodating chamber 21 at positions spaced slightly laterally from the lock arm 46, as shown in FIG. 3. The guide ribs 14 of the mating connector 10 are insertable between the lock arm 46 and the side walls 31.

The lock arm 46 has a base 47 that projects up from the front end of the main portion 42, an arm 48 that extends back from the base 47 and a free end 49 on the arm 48 remote from the base 47, as shown in FIG. 6. The arm 48 can be deformed resiliently or elastically down in response to a downward pushing force on the free end 49 of the arm 48 from above. The rear end of the housing 18 has an arched press-preventing portion 32 that bridges the opposite right and left edges of the mounting groove 30. The press-preventing portion 32 substantially covers a space above the free end 49 of the lock arm 46 when the slider 41 is at the usual position, thereby preventing the upper surface of the lock arm 46 from being pressed mistakenly.

Figure 8:
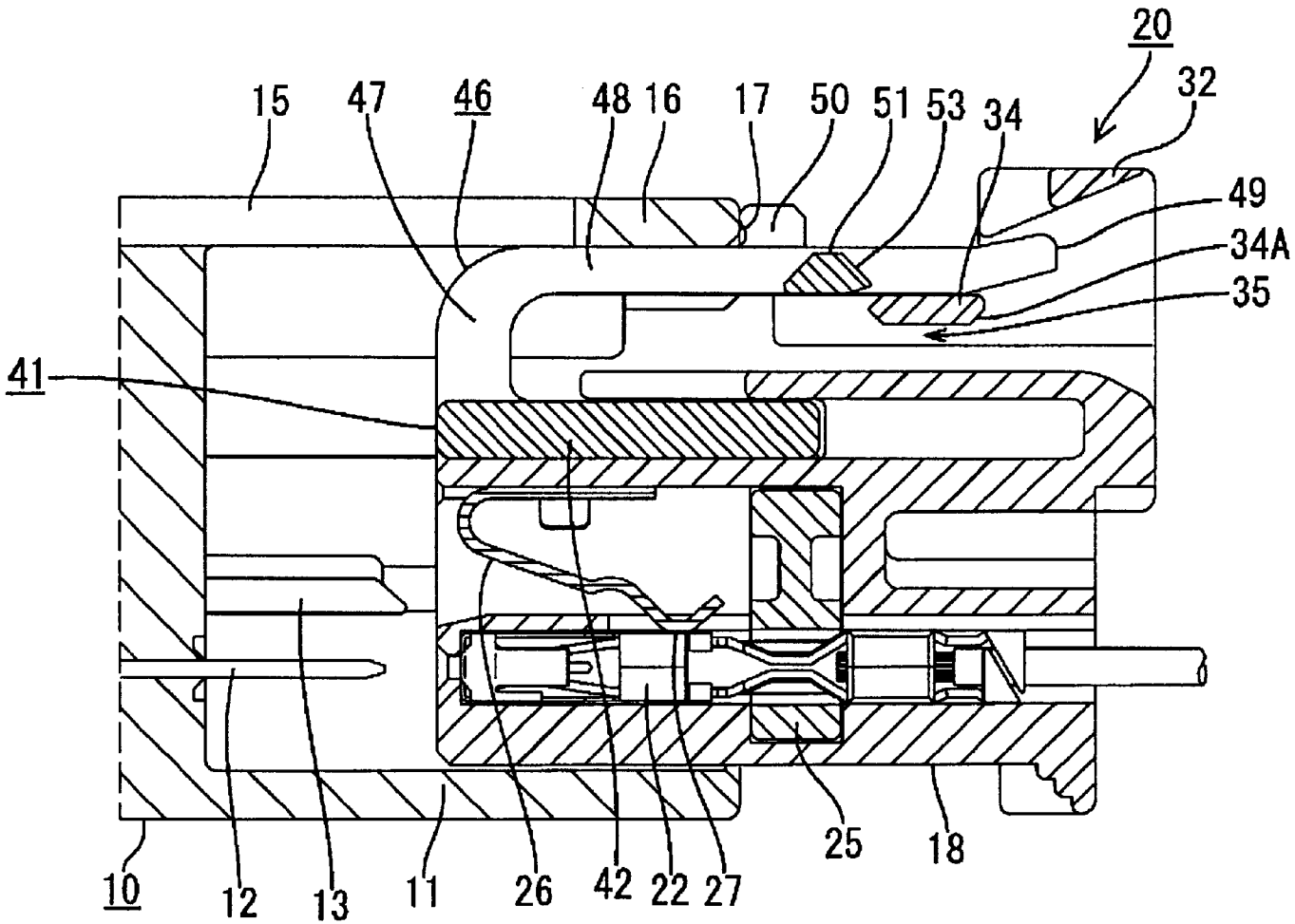
FIG. 8 is a section similar to FIG. 6, but showing a state where a front end surface of a locking portion is in contact with a locking projection.
Figure 9:
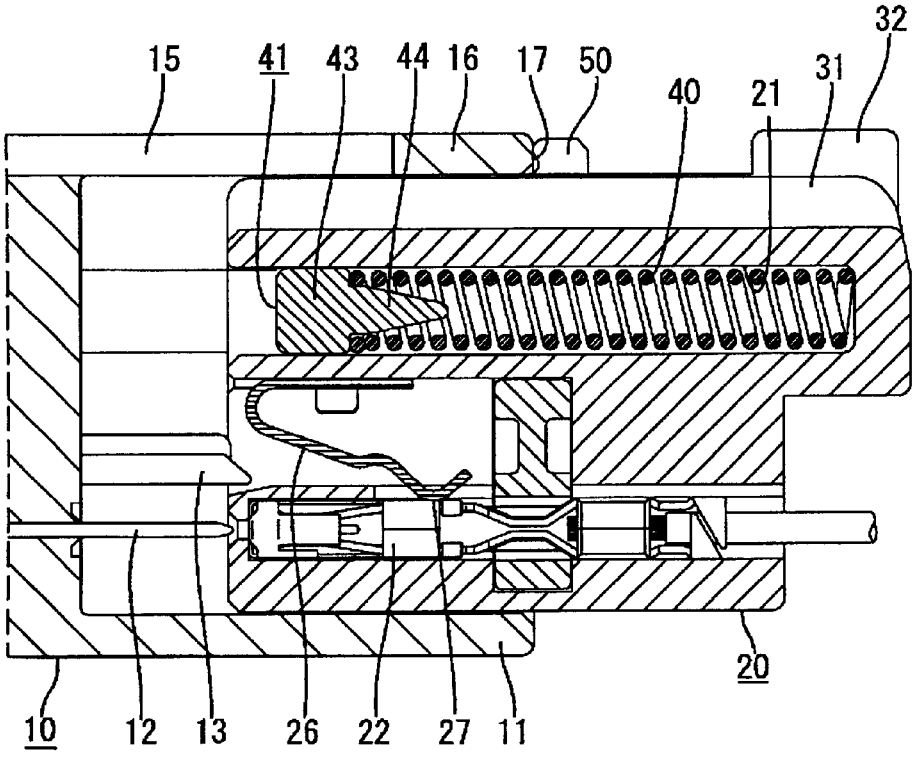
FIG. 9 is a section similar to FIG. 7, but showing a state where coil springs are compressed.
Figure 10:
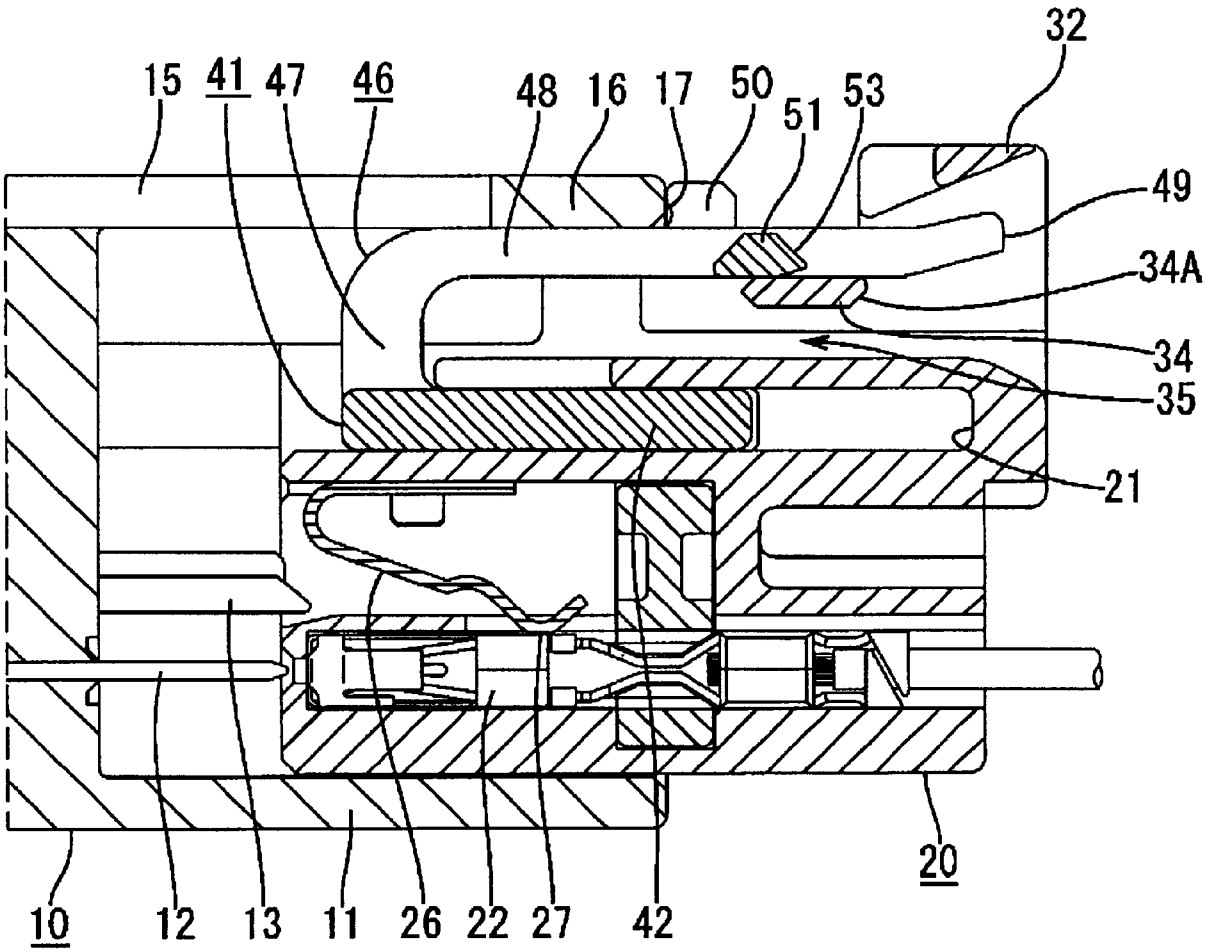
FIG. 10 is a section similar to FIG. 6, but showing a state where the resilient deformation of a lock arm is prevented by insufficient connection preventing portions.
Figure 11:
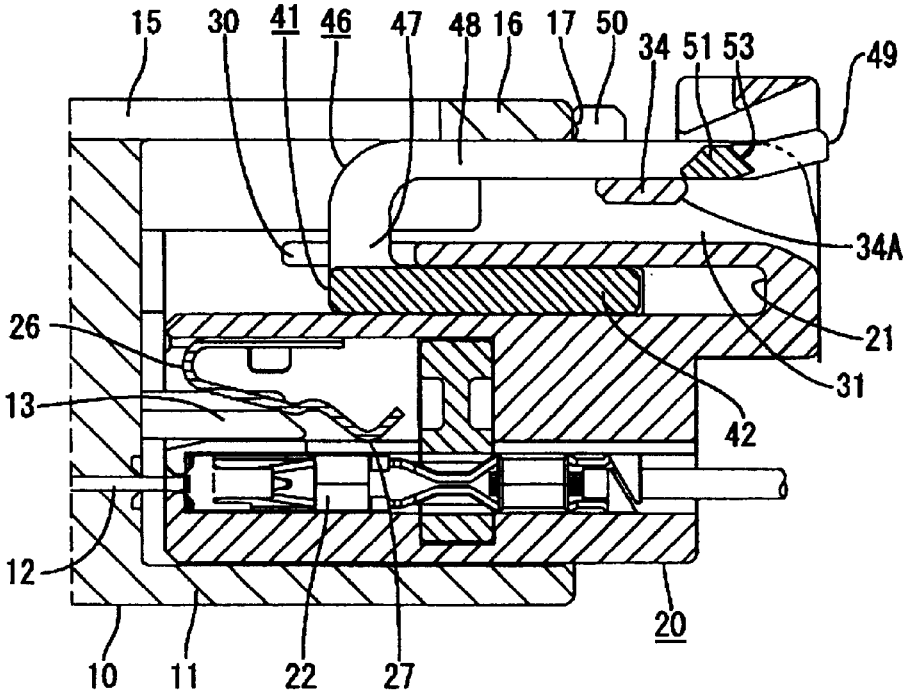
FIG. 11 is a section similar to FIG. 6, but showing a state where the locking projection is guided by stroke guiding portions.
Figure 12:
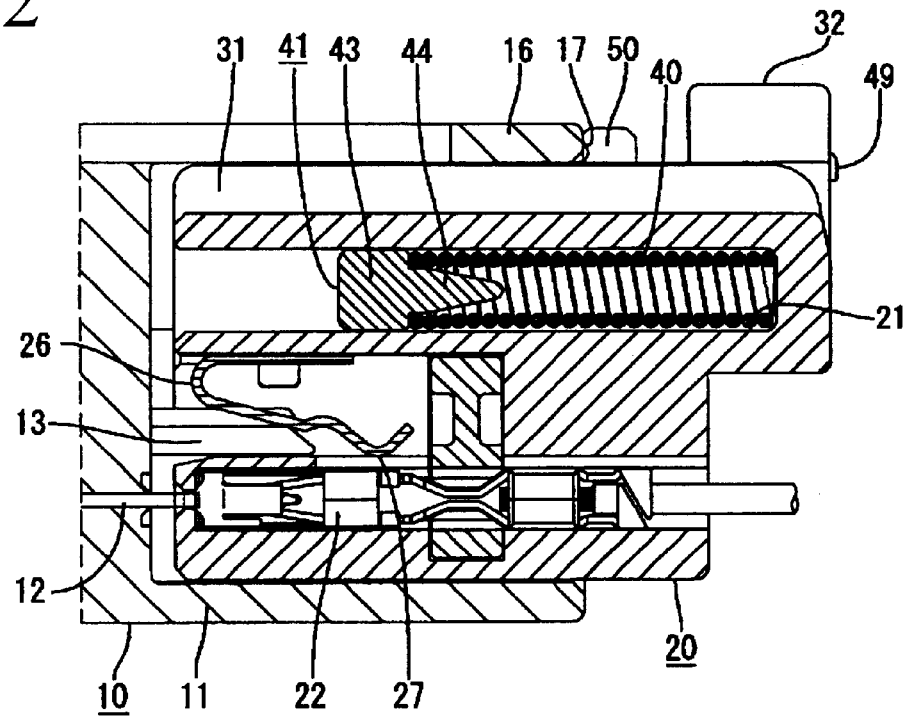
FIG. 12 is a section similar to FIG. 7, but showing the connector in the state of FIG. 11.
Figure 13:
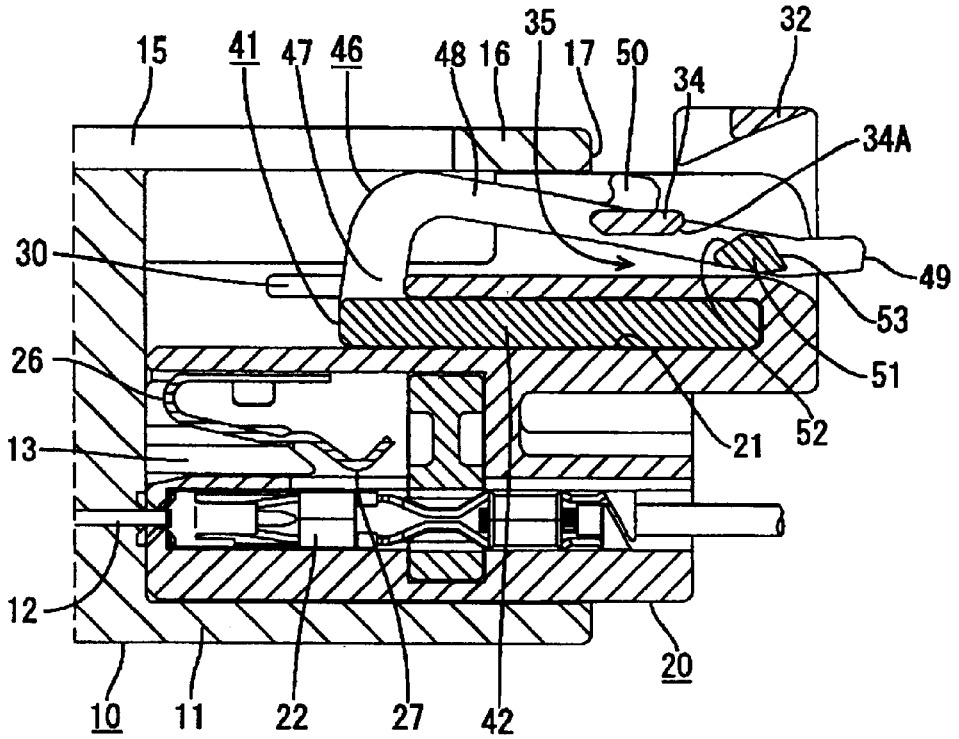
FIG. 13 is a section similar to FIG. 6, but showing a state where the two connectors are properly connected and the lock arm is about to be resiliently deformed.

A locking projection 50 is formed on the upper surface of the arm 48 and is engageable with the lock 16 of the mating connector 10. A front surface 17 of the lock 16 abuts against the locking projection 50 at an intermediate stage of connecting the two connectors 10, 20, as shown in FIG. 8. The front surface 17 pushes the locking projection 50 as the connectors 10, 20 are connected further, thereby moving the slider 41 and the lock arm 46 back with respect to the housing 18 and simultaneously compressing the coil springs 40, as shown in FIGS. 9 and 10. Sufficient downward deformation of the lock arm 46 enables the locking projection 50 to disengage from the front surface 17 of the lock 16, as shown in FIG. 11.

Stroke guides 51 bulge out at a position behind the locking projection 50 from the left and right surfaces of the arm 48 and toward the side walls 31 of the housing 18, as shown in FIG. 4. The stroke guides 51 are substantially trapezoidal in side view, as shown in FIG. 6, and guide surfaces 52, 53 are formed at the front and rear sides of the stroke guides 51.

Figure 5:
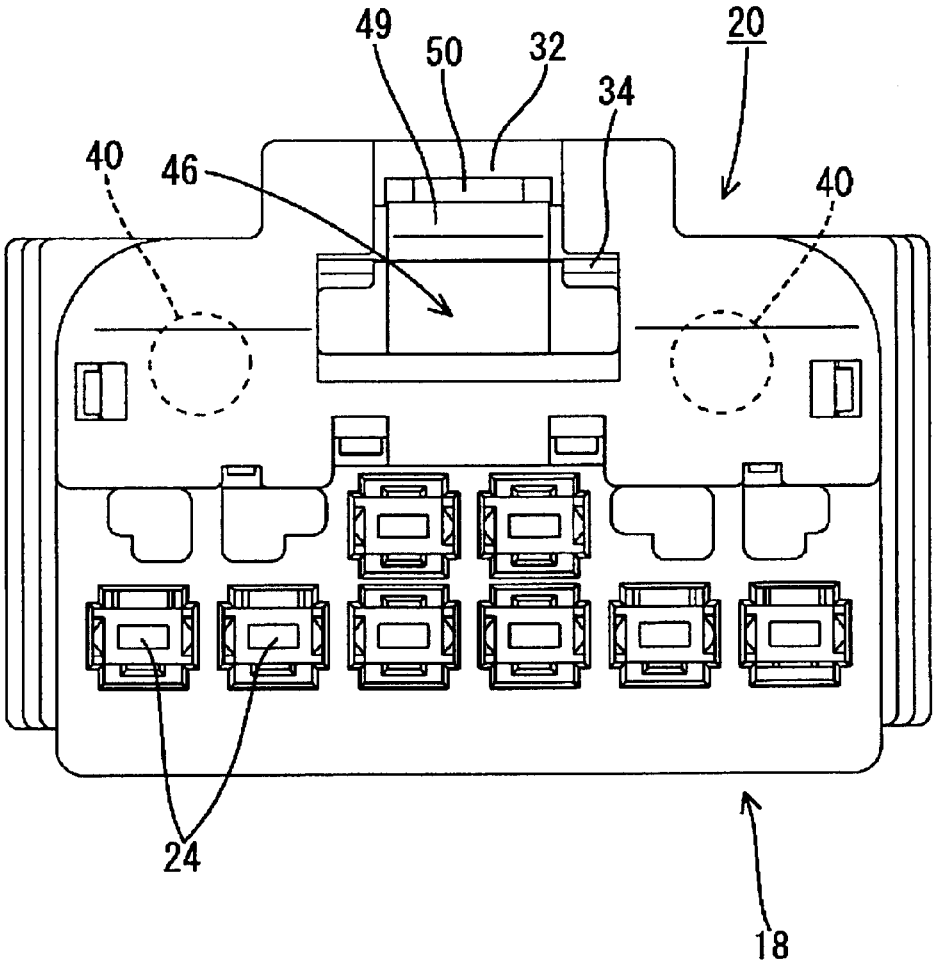
FIG. 5 is a rear view of the connector.

Two insufficient connection preventing portions 34 project toward the lock arm 46 from positions on the side walls 31 of the housing 18 behind the stroke guides 51 of the lock arm 46 when the slider 41 is at the usual position shown in FIGS. 5 and 6. The insufficient connection preventing portions 34 have upper surfaces that are slightly higher than the bottom surfaces of the stroke guides 51 of the lock arm 46. Rear ends of the insufficient connection preventing portions 34 are at positions that permit displacement of the front ends of the stroke guides 51 below the insufficient connection preventing portions 34 when the connectors 10, 20 are properly connected.

The bottom surfaces of the stroke guides 51 are held constantly in contact with the upper surfaces of the insufficient connection preventing portions 34 until the lock arm 46 is deformed resiliently down. This prevents the lock arm 46 from being deformed resiliently down during connection (see FIG. 10). A space 35 is defined below each insufficient connection preventing portion 34, and the stroke guides 51 can pass through the space 35 when the lock arm 46 is deformed resiliently to the position shown in FIG. 13.

The connector 20 may be in the assembled condition during transportation to a location where the connector 20 is connected with the mating connector 10. The lock arm 46 is not likely to be deformed mistakenly or broken because the upper surface of the lock arm 46 is covered by the press-preventing portion 32, as shown in FIG. 6.

The connector 20 then is fitted into the receptacle 11 of the mating connector 10, and the front surface 17 of the lock 16 abuts against the locking projection 50 of the lock arm 46, as shown in FIG. 8. Further insertion causes the front surface 17 of the lock 16 to push the locking projection 50. As a result, the slider 41 is displaced back in the accommodating chamber 21 and the coil springs 40 are compressed, as shown in FIG. 10. The corresponding male and female terminal fittings 12, 22 are brought into contact after compression of the coil springs 40 is started.

The stroke guides 51 of the lock arm 46 pass above the insufficient connection preventing portions 34 during backward movement of the slider 41, as shown in FIG. 11. Thus, the insufficient connection preventing portions 34 prevent the lock arm 46 from being deformed down by mistake during connection. Further movement in the connecting direction pushes the slider 41 to a position where the stroke guides 51 pass the rear ends of the insufficient connection preventing portions 34.

The connecting operation could be interrupted halfway. In this situation, spring forces accumulated in the compressed coil springs 40 are released and push the slider 41 and the lock arm 46 to the front of the housing 18. The connectors 10, 20 are separated as the slider 41 is moved forward to prevent or detect the insufficient connection of the connectors 10, 20.

The connecting operation proceeds until the stroke guides 51 pass the insufficient connection preventing portions 34, as shown in FIG. 11. The lock arm 46 then resiliently returns substantially to its original shape, and the guide surfaces 52 of the stroke guides 51 come into surface contact with guide surfaces 34A of the insufficient connection preventing portions 34. Thus, the stroke guides 51 are guided under the insufficient connection preventing portions 34 by the guide surfaces 52, 34A. At this time, the lock arm 46 is deformed resiliently down and the locking projection 50 is disengaged from the front surface 17 of the lock 16. As a result, forward movement of the slider 41 is cleared and spring forces of the compressed coil springs 40 are released. Consequently, the slider 41 is moved forward with the lock arm 46 resiliently deformed. At this time, the stroke guides 51 of the lock arm 46 pass the spaces 35 below the insufficient connection preventing portions 34.

Figure 14:
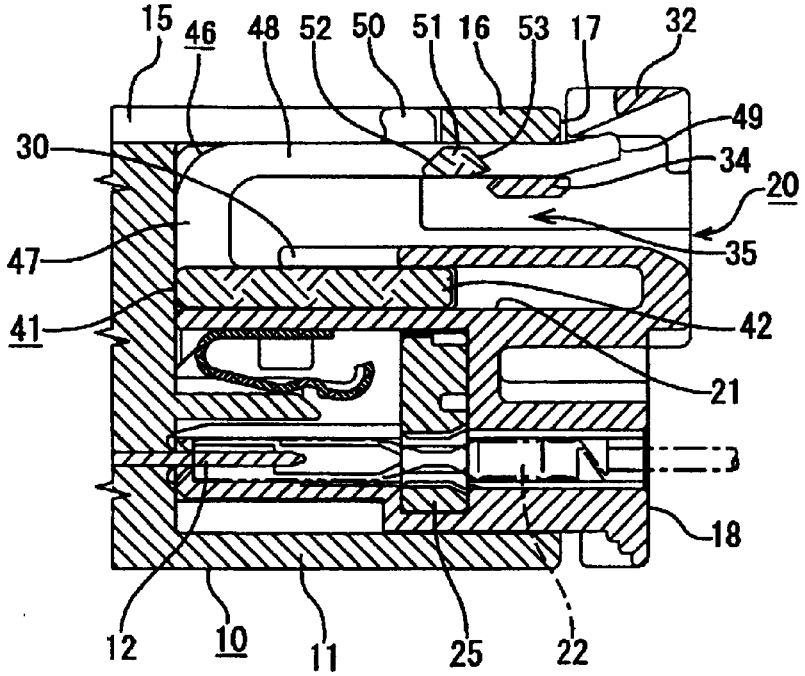
FIG. 14 is a section similar to FIG. 6, but showing a state where the two connectors are held connected.
Figure 15:
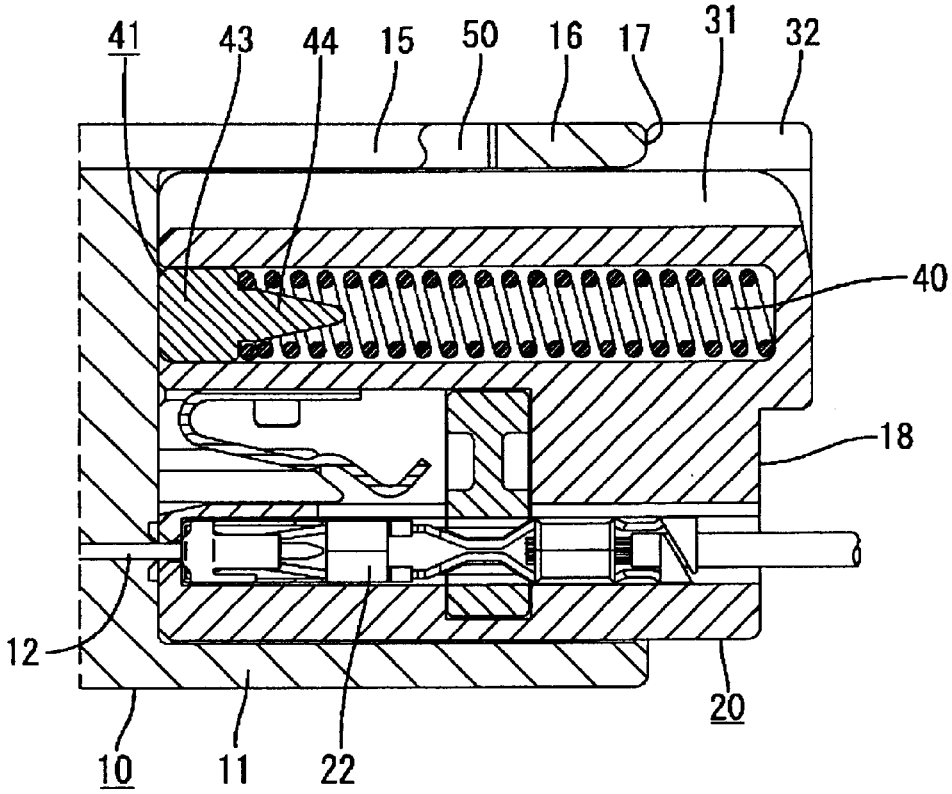
FIG. 15 is a section along Y—Y of the connector in a state where the coil springs are restored to have a length before the connectors are connected.

As shown in FIG. 14, the lock arm 46 and the slider 41 return to the usual positions they had before connection, and the lock arm 46 is restored to engage the locking projection 50 with the lock 16 of the mating connector 10. Thus, the two connectors 10, 20 are connected properly and are locked together. The front-stop projections 45 of the slider 41 contact the stoppers 29 of the connector 20 to stop the slider 41 at its front-limit position, as shown in FIG. 4, and the slider 41 is held in the accommodating chamber 21 of the connector 20. Further, the coil springs 40 are restored to have the length that existed before the connection as shown in FIG. 15.

Figure 16A:
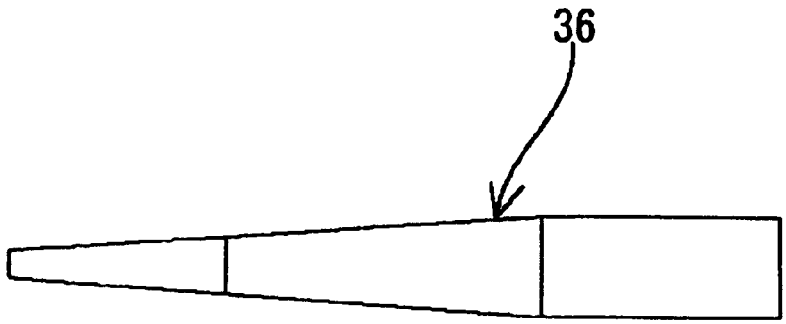
FIGS. 16A and 16B are a side view and a plan view enlargedly showing a leading end portion of a jig, respectively.
Figure 16B:
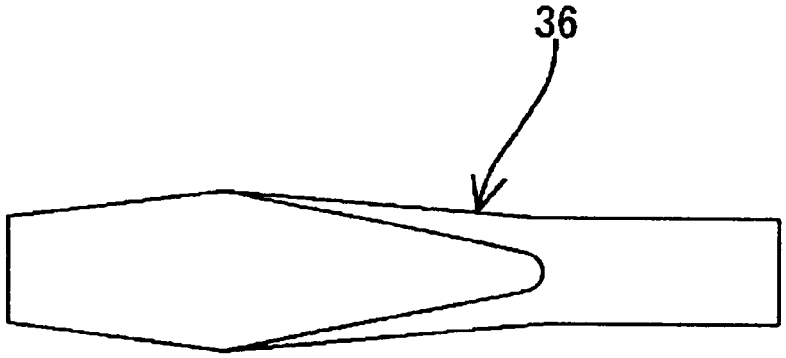
Figure 17:
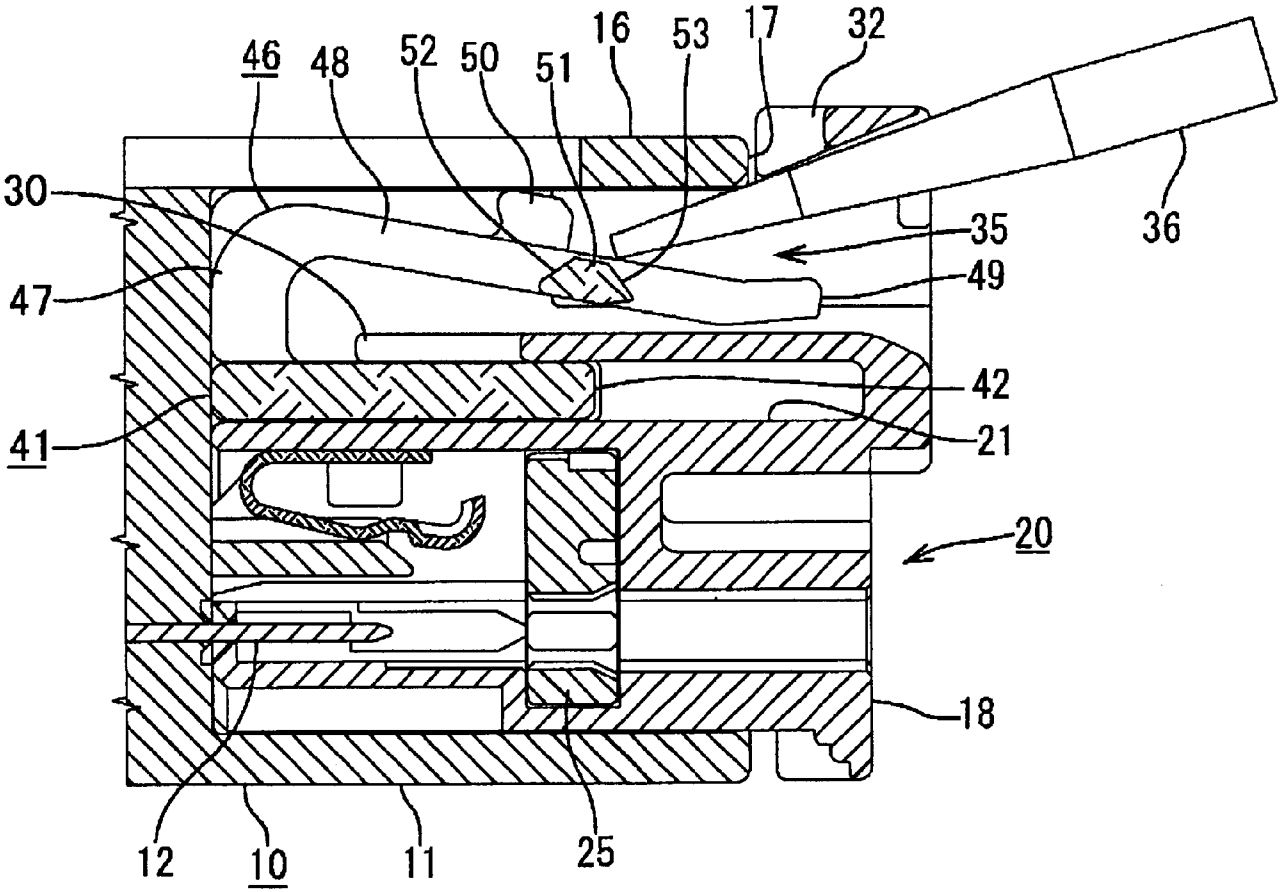
FIG. 17 is a side view in section showing a state where the two connectors properly connected are detached using the jig.
Figure 18:
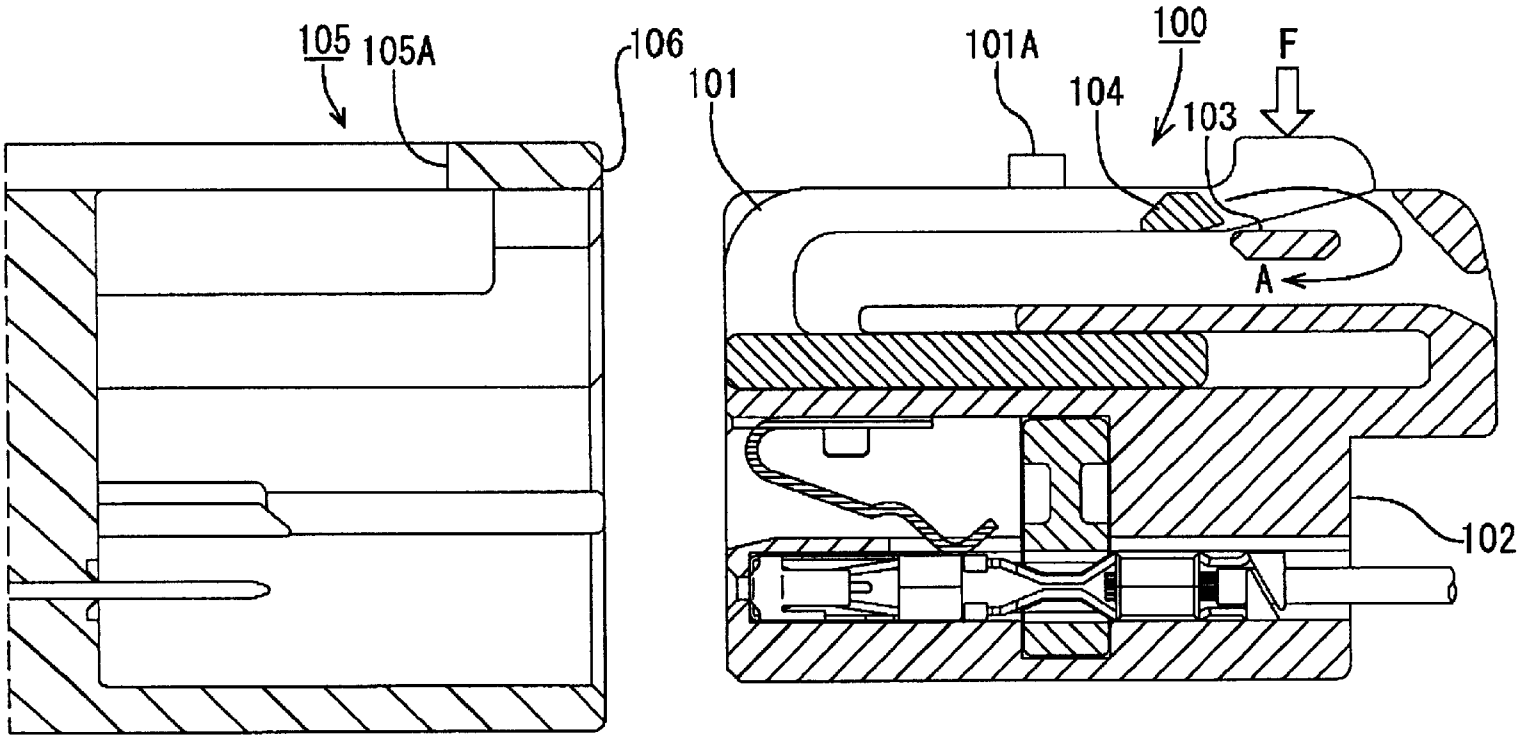
FIG. 18 PRIOR ART
FIG. 18 is a side view in section of a prior art connector.

The connectors 10, 20 may have to be detached for maintenance or for another reason. In such a case, a jig 36 in the form of a shank of a screwdriver with a flat leading end as shown in FIGS. 16A and 16B is used to deform the lock arm 46 down. As shown in FIG. 17, the jig 36 is inserted between the press-preventing portion 32 and the free end 49 of the lock arm 46 and presses the upper surface of the lock arm 46 down with the press-preventing portion 32 as a fulcrum. In this way, the lock arm 46 is deformed resiliently to disengage the locking projection 50 from the lock 16, thereby detaching the two connectors 10, 20.

The housing 18 has the press-preventing portion 32, and therefore the lock arm 46 is not pressed by mistake, and the two connectors 10, 20 can be connected more securely with each other.

Further, the press-preventing portion 32 is coupled to opposite lateral edges of the mounting groove 30 and hence contributes to the strength of the housing 18.

Furthermore, the jig 36 must be used to detach the two connectors 20, 10. Therefore, the properly connected connectors 20, 10 are not detached by mistaken.

The press-preventing portion 32 can be used as a fulcrum of the jig 36 when the two connectors 20, 10 are to be detached. Therefore, the detaching operation can be performed more easily.

The press-preventing portion 32 also can protect the lock arm 46 when the connector 20 is transported to a place where the connector 20 is connected with the mating connector 10.

The invention is not limited to the above-described embodiment, and the following embodiments also are embraced by the technical scope of the invention as defined in the claims.

The number of the insufficient connection preventing portions 34 and the stroke guides 51 is not limited to two, but may be one, three or more. Further, the position of the lock arm 46 with respect to the housing 18 is not necessarily substantially in the middle of the housing 18, but may be displaced transversely. Furthermore, the press-preventing portion 32 does not necessarily cover the entire upper surface of the rear end of the lock arm 46 but may cover only a distal end portion thereof.

The present invention may be applied to male connectors instead of female connectors.

What is claimed is:

1. A connector, comprising:

a housing for at least partly accommodating terminal fittings, a resiliently deformable lock arm slidably mounted in the housing and being configured to lock the connector and a mating connector into each other, at least one biasing member for biasing the lock arm toward a usual position along a connection direction with the mating connector, an insufficient connection preventing portion on the housing, and a press-preventing portion provided on the housing to prevent the lock arm from being pressed from above when the lock arm is at the usual position.

2. The connector of claim 1, wherein the insufficient connection preventing portion projects from the housing toward the lock arm.

3. The connector of claim 1, wherein a stroke guide is provided on the lock arm and moves onto the insufficient connection preventing portion as the lock arm is moved backward of the housing from the usual position by being pressed by the mating connector during connection the connector with the mating connector.

4. A connector according to claim 3, wherein the stroke guide comprises at least one guide surface for surface contact, with at least one corresponding guide surface of the insufficient connection preventing portion.

5. The connector of claim 1, wherein the lock arm is mounted in a mounting groove formed in the housing and the press-preventing portion is formed to bridge the opposite lateral edges of the mounting groove.

6. The connector of claim 1, wherein front-stop means are provided on the lock arm for contacting stop means in the connector and for locating the lock arm in the usual position.

7. The connector of claim 1, wherein a jig is insertable between the press-preventing portion and the lock arm for detaching the connector from the mating connector.

8. The connector according to claim 7, wherein the press-preventing portion acts as a fulcrum for the jig for deflecting the lock arm when the connector is to be detached from the mating connector.

9. The connector of claim 1, wherein side walls are provided on the housing at positions slightly spaced apart sideways from the lock arm to substantially surround the side surfaces of the lock arm.

10. The connector of claim 1, wherein the lock arm has a base end and a free end that is deflectable relative to the base end, the press-preventing portion at least partly overlapping the free end of the lock arm for preventing the lock arm from being pressed from above when the lock arm is at the usual position.

11. A connector, comprising:

a housing with opposite front and rear ends and a plurality of parallel cavities extending through the housing from the front end to the rear end for accommodating terminal fittings, a groove formed in the housing and extending substantially parallel to the cavities;

a resiliently deformable lock arm mounted in the housing for sliding movement substantially parallel to the cavities and being configured to lock the connector to a mating connector, at least a portion of the lock arm being slidably disposed in the groove;

at least one biasing member for biasing the lock arm toward the front end of the housing;

an insufficient connection preventing portion projecting into the groove on the housing for preventing the lock arm from being deformed before the connector is connected to the mating connector; and a press-preventing portion provided on the housing and bridging at least portions of the groove and the lock arm to prevent the lock arm from being pressed from above.

* * * * *